US006296243B1

(12) United States Patent
Nishimura

(10) Patent No.: US 6,296,243 B1
(45) Date of Patent: Oct. 2, 2001

(54) SHEET SUPPLY APPARATUS

(75) Inventor: Yasuhiro Nishimura, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/519,620

(22) Filed: Mar. 6, 2000

(30) Foreign Application Priority Data

Mar. 18, 1999 (JP) ..... 11-073987

(51) Int. Cl.[7] ..... B65H 3/06; B65H 9/12

(52) U.S. Cl. ..... 271/116; 271/126; 271/226; 271/241; 399/81

(58) Field of Search ..... 271/226, 241, 271/147, 152, 155, 10.03, 10.07, 10.11, 10.13, 114, 116, 126; 399/372, 81

(56) References Cited

U.S. PATENT DOCUMENTS 5,294,108 * 3/1994 Pollich et al. ..... 271/241
5,553,843 * 9/1996 Schenk ..... 271/226

FOREIGN PATENT DOCUMENTS

0104522 * 4/1989 (JP) ..... 271/241

* cited by examiner

*Primary Examiner*—H. Grant Skaggs
(74) *Attorney, Agent, or Firm*—Kanesaka & Takeuchi

(57) ABSTRACT

A sheet supply apparatus for supplying record sheets to an image forming apparatus, the sheet supply apparatus including a sheet supply table for supporting the record sheets stacked thereon, sheet supply means provided above the sheet supply table and contacting a topmost face of the record sheets for supplying the one record sheet to the image forming apparatus during one period comprising a sheet supply executing time period for supplying the record sheet to the image forming apparatus and a sheet supply nonexecuting time period for not supplying the record sheet thereto, left and right movement instructing means for instructing to move the sheet supply table in a direction orthogonal to a transfer direction of the record sheet, left and right moving means for moving the sheet supply table in response to an instruction from the left and right movement instructing means, and control means for executing a control of moving the sheet supply table when a sheet supply operation by the sheet supply means is stopped in the sheet supply nonexecuting time period in the case in which the control means is instructed to move the sheet supply table by the left and right movement instructing means.

6 Claims, 8 Drawing Sheets

SHEET SUPPLY APPARATUS

BACKGROUND OF THE INVENTION

1. Field of the Invention

The present invention relates to a sheet supply apparatus for supplying record sheet to an image forming apparatus such as a stencil printing machine or the like, particularly to a sheet supply apparatus capable of adjusting print position of print sheet in the left and right direction even in sheet supply operation.

2. Description of the Related Art

An image forming apparatus for forming an image by using record sheet, for example, print sheet for general use, uses the print sheet by loading the print sheet on a sheet supply table. Particularly, in the case of a stencil printing machine, high speed printing can be carried out since the printing operation is carried out by mounting stencil sheet on a print drum at inside of the machine and rotating the print drum. In correspondence therewith, there is constructed a constitution in which a comparatively large number of sheets of print sheet are loaded on the sheet supply table and the large number of sheets of print sheet can continuously be supplied in a short period of time in correspondence with printing speed.

The sheet supply table is constituted such that print sheet disposed at sheet supply position on the topmost face is supplied to a print section at inside of the printing machine sheet by sheet. A scraper roller (sheet supply roller) of the sheet supply section is provided at the sheet supply position and print sheet can continuously be supplied to inside of the apparatus by rotating the scraper roller.

Further, there is constructed a constitution in which the sheet supply table is controlled to elevate in correspondence with supply of the print sheet and print sheet at the topmost face is always brought into contact with the scraper roller.

According to the print sheet, a position thereof in the left and right direction (width direction orthogonal to a transfer direction) is made variable in supplying the print sheet from the sheet supply table to the print section to thereby enable to move an image forming position in the left and right direction on the print sheet. For example, in the case of a stencil printing machine, by making variable a transfer position in the left and right direction of print sheet relative to the print drum, a contact position of the print sheet relative to an image position of stencil sheet mounted to the print drum can be made variable in the left and right direction and the image forming position on the print sheet can be moved in the left and right direction.

FIG. 8 is a perspective view showing a sheet supply apparatus. A sheet supply table 50 loaded with print sheet is provided with a dial 51 for moving the sheet supply table 50 in the left and right direction. By manually adjusting the dial 51, a screw shaft 52 is rotated, a nut portion 53 fixed to the sheet supply table 50 is moved in the left and right direction and the sheet supply table 50 is moved in the same direction. Thereby, an image forming position on print sheet P can be adjusted to move in the left and right direction.

Print sheet P at the topmost face loaded on the sheet supply table 50, is brought into contact with a scraper roller 57*a* of sheet supply means 57 provided above the sheet supply table 50 and the print sheet is supplied sheet by sheet from the topmost face to a print section by rotating the scraper roller 57*a*.

The sheet supply table 50 is constituted such that the sheet supply table 50 is controlled to elevate gradually in compliance with supply of the print sheet P and the topmost face of the print sheet P is always brought into contact with the scraper roller 57*a* and can be supplied to the print section.

However, according to the above-described constitution, the sheet supply table 50 can be moved in the left and right direction directly by operating the dial 51. Therefore, when the dial 51 is operated in the printing operation, the print sheet P is supplied in an oblique direction, wrinkle is produced in the print sheet P, or the print sheet P is folded, as a result, sheet supply jam is caused.

Further, the scraper roller 57*a* undergoes damage, which gives rise to deterioration in print function at an early stage.

In the meantime, it is conceivable to move the sheet supply table by electrical drive using a motor or the like in place of the manual operation. However, the above-described problem cannot be solved at all by a constitution in which the sheet supply table is moved in the left and right direction simply by power of the motor.

SUMMARY OF THE INVENTION

The present invention has been carried out in order to resolve the above-described problems and it is an object of the present invention to provide a sheet supply apparatus capable of always stably supplying sheet without stopping image forming operation and without exerting unnecessary force onto record sheet in adjusting a position of record sheet for forming an image in a left and right direction and by controlling operation of adjusting in the left and right direction in accordance with a sheet supply operational state even in sheet supply operation.

According to a first aspect of the present invention, there is provided a sheet supply apparatus for supplying record sheets to an image forming apparatus, the sheet supply apparatus comprising a sheet supply table for supporting the record sheets stacked thereon, sheet supply means provided above the sheet supply table and contacting a topmost face of the record sheets for supplying the record sheets one by one to the image forming apparatus during one period comprising a sheet supply executing time period for supplying the record sheet to the image forming apparatus and a sheet supply nonexecuting time period for not supplying the record sheet thereto, left and right movement instructing means for instructing to move the sheet supply table in a direction orthogonal to a transfer direction of the record sheet, left and right moving means for moving the sheet supply table in response to an instruction from the left and right movement instructing means, and control means for executing a control of moving the sheet supply table when a sheet supply operation by the sheet supply means is stopped in the sheet supply nonexecuting time period in the case in which the control means is instructed to move the sheet supply table by the left and right movement instructing means.

According to a second aspect of the present invention, there is provided the sheet supply apparatus according to the first aspect, further comprising transfer means which is provided on a side of the image forming apparatus and to which the sheet supply means delivers the record sheet, wherein the sheet supply means includes a sheet supply roller and a sheet supply clutch for transmitting a drive force to the sheet supply roller, and wherein the control means moves the sheet supply table in a left and right direction during a time period in which the sheet supply roller is driven to rotate by the record sheet transferred by the transfer means by cutting the sheet supply clutch.

According to a third aspect of the present invention, there is provided the sheet supply apparatus according to the first aspect wherein the control means executes a control of moving the sheet supply table by a constant amount in a corresponding direction each time of operating the left and right movement instructing means by one time.

According to a fourth aspect of the present invention, there is provided the sheet supply apparatus according to the first aspect wherein the control means executes a control of moving the sheet supply table in a left and right direction by a constant amount in a corresponding direction only once in the sheet feed nonexecuting time period within the one period of the sheet supply means regardless of a duration time period of operating the left and right movement instructing means by one time and by an operation of the one time.

According to a fifth aspect of the present invention, there is provided the sheet supply apparatus according to the first aspect wherein when the sheet supply means executes to supply the record sheet during a time period of operating the left and right movement instructing means by one time, the control means controls to move the sheet supply table by a remaining moving amount of a constant amount of moving the sheet supply table in a left and right direction at a time point at which the period of the sheet supply means is switched to the sheet supply nonexecuting time period.

According to a sixth aspect of the present invention, there is provided the sheet supply apparatus according to any one of the first through the fourth aspects wherein the left and right movement instructing means includes a left and right moving key for moving the sheet supply table in either desired direction of left and right directions and wherein the control means is constituted to control to move the sheet supply table in the left and right direction by detecting a state of depressing the left and right moving key.

According to the above-described constitution, the record sheet is loaded on the sheet supply table and the record sheet at the topmost face above the sheet supply table is brought into contact with the sheet supply means and is supplied to the image forming apparatus sheet by sheet.

When a position of the image on the record sheet is adjusted in the left and right direction by depressing the left and right moving key, the control means moves the sheet supply table in the left and right direction by the left and right moving means during a time period of not executing sheet supply operation in which the scraper roller of the sheet supply means is made to stop rotating. The sheet supply table is not moved in the left and right direction when sheet supply is being executed by driving to rotate the scraper roller. Thereby, the left and right adjustment can be carried out without supplying sheet while the record sheet and the sheet supply means rub each other.

BRIEF DESCRIPTION OF THE DRAWINGS

FIG. 1(*b*) is a plane view showing the embodiment of the sheet supply apparatus according to the present invention;

DETAILED DESCRIPTION

Figure 1:
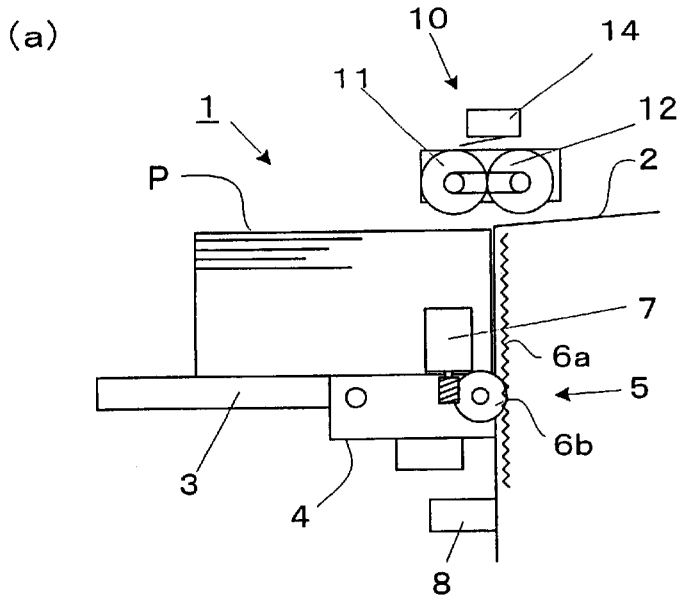
FIG. 1(*a*) is a side view showing an embodiment of a sheet supply apparatus according to the present invention.
Figure 1:
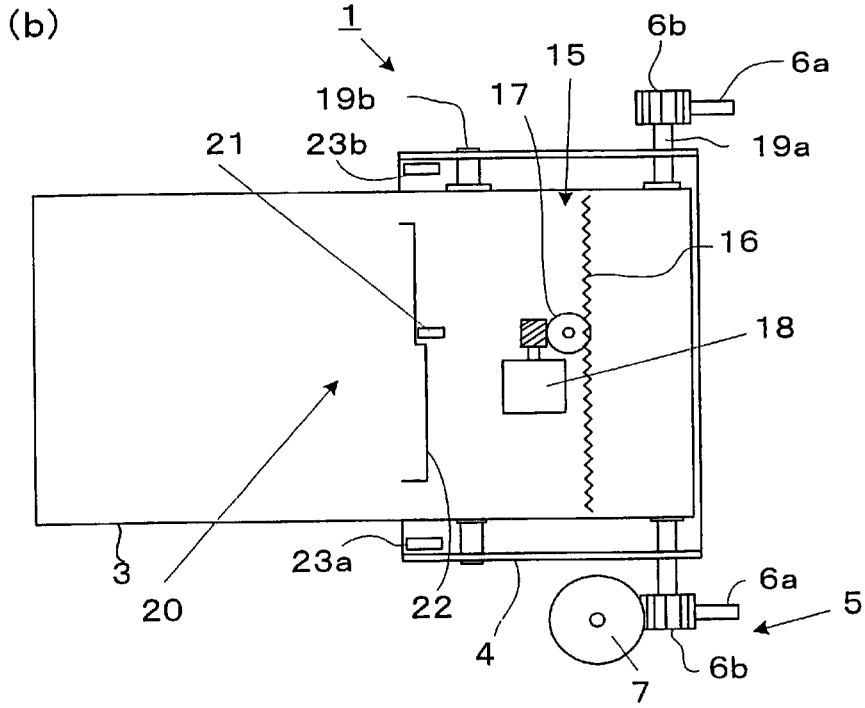

FIGS. 1(*a*) and 1(*b*) are views showing a sheet supply apparatus according to the present invention. FIG. 1(*a*) is a side view and FIG. 1(*b*) is a plane view.

A sheet supply apparatus 1 is provided on one side (left side in the drawing) of an image forming apparatus 2 and is provided with a sheet supply table 3 capable of loading record sheet (hereinafter, referred to as print sheet) P of a predetermined number of sheets.

The sheet supply table 3 is provided above a hold frame 4 and can be moved in the up and down direction by an elevating means 5. The elevating means 5 is constituted by a pair of rack gears 6*a* provided on the side of the image forming apparatus 2 and extended in the up and down direction and pinion gears 6*b* provided on the side of the sheet supply table 3 and in mesh with the rack gears 6*a*. The pinion gears 6*b* are driven to rotate by an elevator motor 7 by which the sheet supply table 3 can be moved to elevate or lower. A lower limit sensor 8 detects a lower limit position of the sheet supply table 3 in lowering the sheet supply table 3.

Further, the image forming apparatus 2 is provided with sheet supply means 10 which can be brought into contact with the print sheet P at the topmost face above the sheet supply table 3. The sheet supply means 10 is constituted by a scraper roller 11 and a pickup roller 12 and is driven to rotate intermittently in synchronism with printing operation to thereby charge the print sheet P to inside of the image forming apparatus 2 sheet by sheet.

The print sheet P is brought into contact with the scraper roller 11 of the sheet supply means 10 at the sheet supply position under predetermined pressure by controlling to elevate the sheet supply table 3. The contact pressure differs according to kinds of the print sheet P such as a thickness thereof. The contact pressure of the sheet supply means 10 is detected by an upper limit sensor (sheet supply position detecting means) 14 and is outputted to a control section and control means controls to elevate or lower the sheet supply table 3 such that sheet can be supplied always under optimum contact pressure. Thereby, stable supply can be carried out by preventing laminated feed or vacant feed in supplying the print sheet P.

Further, the sheet supply table 3 can be moved in the left and right direction (direction orthogonal to transfer direction of print sheet P: width direction of print sheet P) relative to the image forming apparatus 2 within the hold frame 4 by left and right moving means 15.

That is, on the side of the sheet supply table 3, a rack gear 16 is provided and on the side of the hold frame 4, a pinion gear 17 in mesh with the rack gear 16 and a left and right moving motor 18 for driving are provided. The sheet supply table 3 is moved in the left and right direction relative to the hold frame 4 by driving to rotate the left and right moving motor 18.

Further, the sheet supply table 3 is held by the hold frame 4 to be able to move in the left and right direction by support shafts 19*a* and 19*b* extended in the left and right direction. Among the support shafts 19*a* and 19*b*, both ends of the support shaft 19*a* are fixed with the pinion gears 6*b* of the elevating means 5.

An original point (home position) of the position of the sheet supply table 3 in the left and right direction is detected by original point detecting means 20. The original point detecting means 20 is constituted by an original point sensor 21 of a light projection and reception integrated type fixed to a central position in the left and right direction (width direction) of the hold frame 4 and a shield plate 22 provided on the side of the sheet supply table 3 for shielding (or transmitting) light from the original point sensor 21 when the sheet supply table 3 is disposed at the central position in the left and right direction.

Further, the hold frame 4 is provided with a right limit switch 23*a* and a left limit switch 23*b* for detecting right and left limit positions of the sheet supply table 3 above the hold frame 4.

Figure 2:
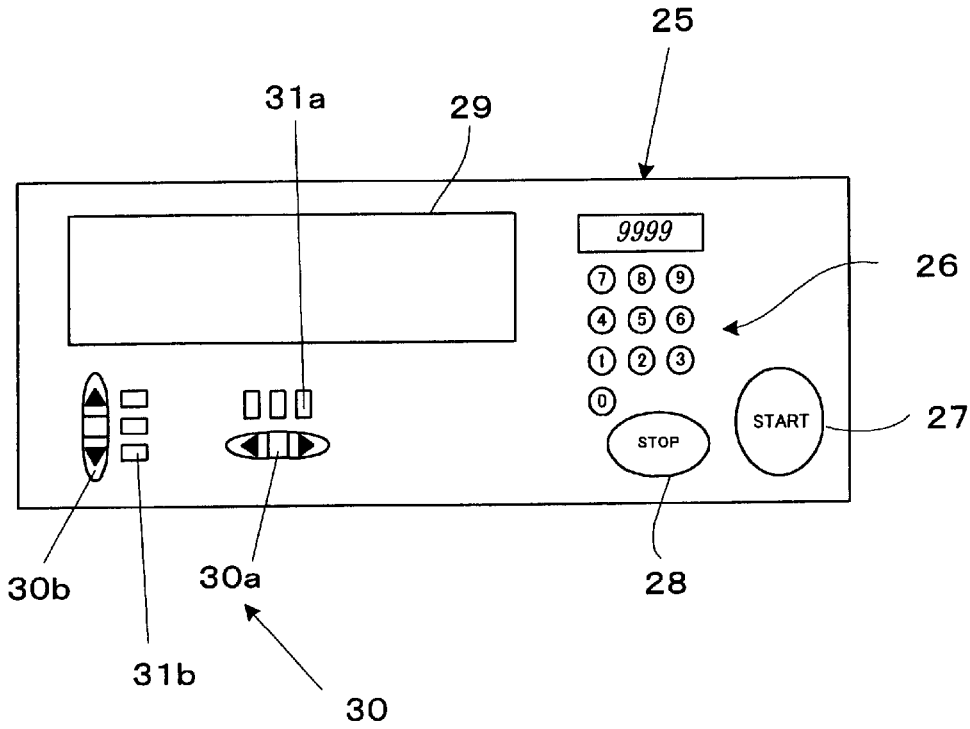
FIG. 2 is a view showing an operation panel.

FIG. 2 is a view showing an operation panel 25 provided at the image forming apparatus 2. The operation panel 25 is provided with a set key 26 for setting a number of printed sheets or the like, a print operation start key 27, a stop key 28, a display portion 29 for displaying set content or print state and the like.

Further, there is provided image position adjusting means 30 for adjusting a position of forming an image on the print sheet P. The image position adjusting means 30 is constituted by a vertically moving key 30*a* for adjusting a vertical position (up and down position) of the image relative to the print sheet P and a left and right moving key (left and right moving instruction means) 30*b* for adjusting a left and right position orthogonal to the vertical position.

In correspondence with operation of the vertically moving key 30*a*, at inside of the image forming apparatus 2, the vertical position of the image relative to the print sheet P is adjusted by making variable a transfer state of the print sheet P. The state of the vertical adjustment is displayed by a vertical position displaying portion 31*a* comprising LED (Light Emitting Diode) or the like.

The left and right moving key 30*b* is constituted by a key for moving the sheet supply table 3 in the left direction, a key for moving the sheet supply table 3 in the right direction and a key for returning the sheet supply table 3 to the original point.

When the left and right moving key 30*b* is operated, the left and right moving motor 18 of the sheet supply table 3 is driven, the sheet supply table 3 is moved in the left and right direction and the left and right position of the image relative to the print sheet P is adjusted. The state of the left and right adjustment is displayed by a left and right display portion 31*b* comprising LED or the like.

These adjustments are controlled to operate by control means, mentioned later.

Figure 3:
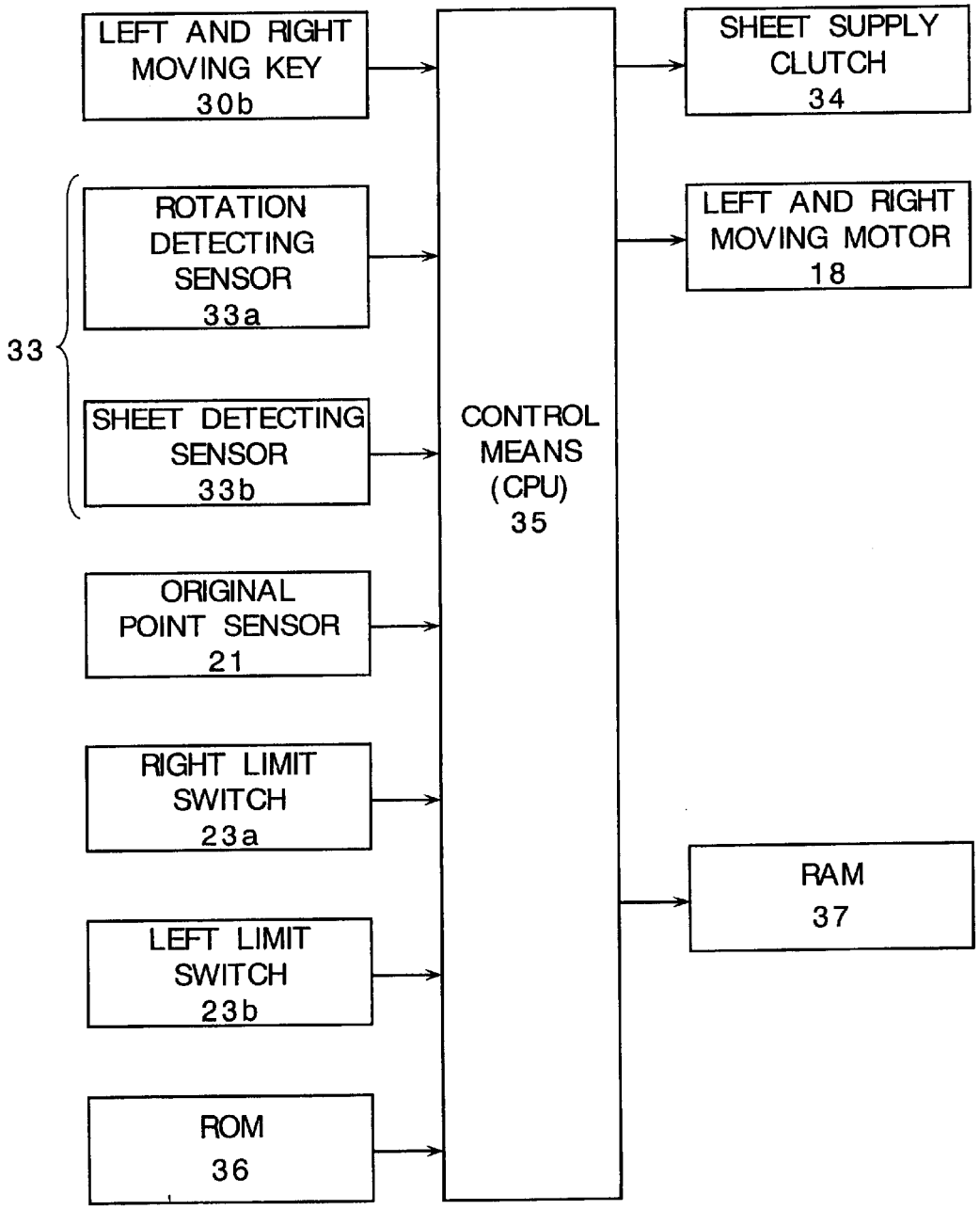
FIG. 3 is a block diagram showing an electrical constitution of the sheet supply apparatus.

FIG. 3 is a block diagram showing an electrical constitution of the apparatus.

Control means 35 is constituted by a microprocessor (CPU), executes control program stored in ROM 36 and executes sheet supply control, mentioned later, by temporarily using RAM 37 for storing data. Hereinafter, an explanation will be given mainly of left and right movement control constituting an essential portion of the present invention.

The control means 35 is inputted with respective detected signals of the lower limit sensor 8, the upper limit sensor 14, the original point sensor 21, the right limit switch 23*a*, the left limit switch 23*b* and sheet supply detecting means 33. Further, the control means 35 is inputted with an operational signal of the left and right moving key 30*b*.

The control means 35 controls to supply the print sheet P by controlling to make a sheet supply clutch (electromagnetic clutch) 34 ON/OFF based on these detected signals and the operational signal. Further, the control means 35 adjusts the left and right position of the sheet supply table 3 by controlling to drive the left and right moving motor 18 based on control of the sheet supply clutch 34.

The sheet supply detecting means 33 is constituted by a rotation detecting sensor 33*a* and a sheet detecting sensor 33*b*. The rotation detecting sensor 33*a* is provided at a rotating shaft rotating in cooperation with printing operation. The image forming apparatus 2 executes one sheet of printing by one rotation of the rotating shaft.

An explanation will be given of content of sheet supply control in reference to timing charts of FIGS. 4(*a*), 4(*b*) and 4(*c*). In this example, an explanation will be given of a case in which the image forming apparatus is a stencil printing machine as an example.

The stencil printing machine executes one sheet of printing by rotating the print drum by one rotation. There is provided a rotating shaft rotating along with rotation of the print drum and the rotating shaft is provided with an encoder plate. A slit is formed at a predetermined angular range of one rotation of the encoder plate. As shown by FIG. 4(*a*), according to the rotation detecting sensor 33*a* on the fixed side, light is detected (ON) at the slit portion by projecting and receiving light to and from the encoder plate. As illustrated, a period T for printing one sheet of the print sheet P is a time period from when the rotation detecting sensor 33*a* is made ON to when the rotation detecting sensor 33*a* is successively made ON.

Figure 4:
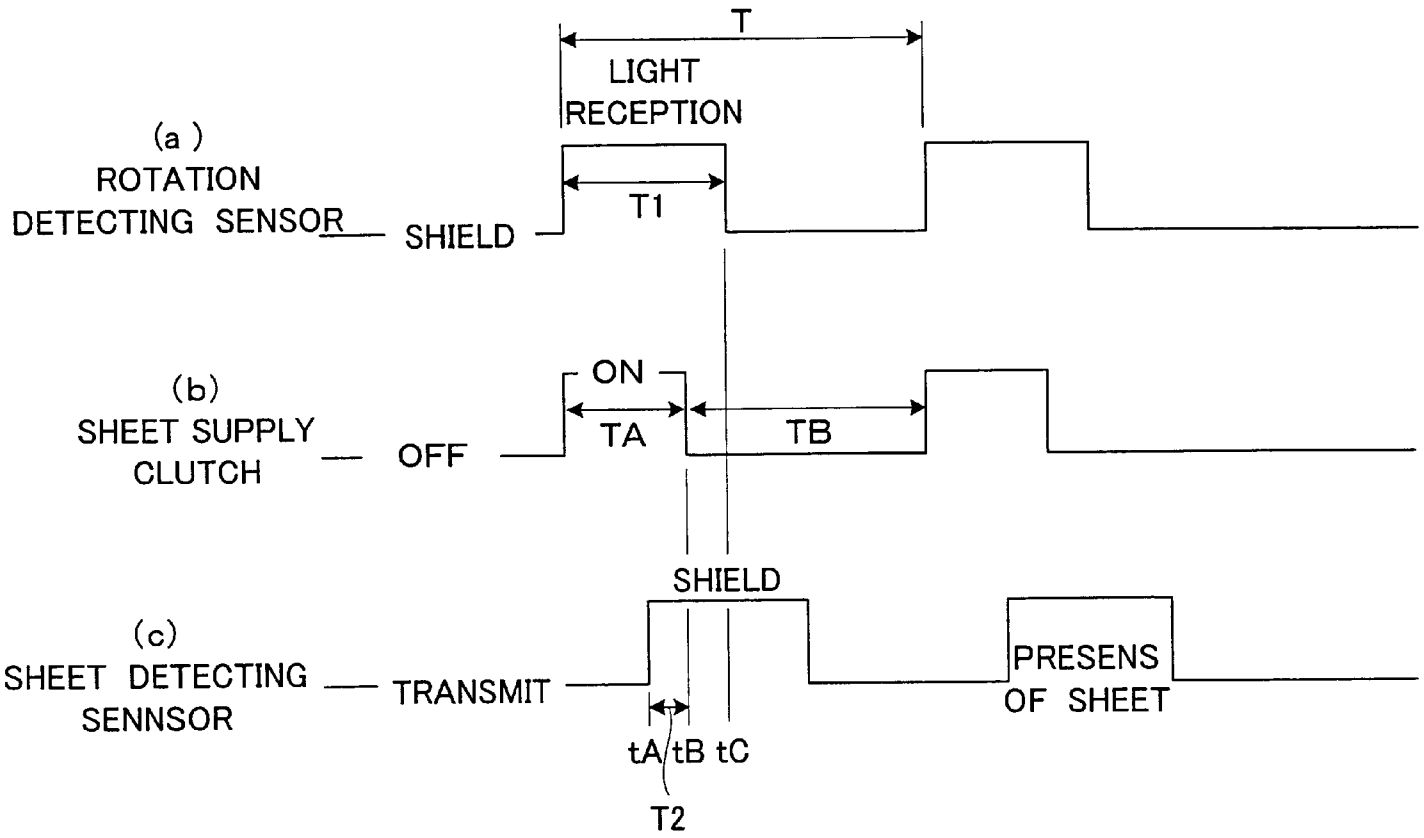
FIGS. 4(*a*), 4(*b*) and 4(*c*) are timing charts showing content of sheet supply control.

In correspondence with a time period T1 during which the rotation detecting sensor 33*a* is made ON, the control means 35 makes ON the sheet supply clutch 34 provided at the sheet supply means 10 (corresponding to primary sheet supply means) during a predetermined time period (TA) (FIG. 4(*b*)) and rotates the scraper roller 11 and the pickup roller 12 to thereby transfer to supply the print sheet P.

Thereby, there is constructed a constitution in which the print sheet P is primarily supplied by the sheet supply means 10 during the predetermined time period in the time period of rotating the print drum by one rotation.

Further, after the primary sheet supply by the sheet supply means 10, the print sheet P is conveyed to transfer means (secondary sheet supply means) provided on the side of the stencil printing machine and the print sheet P is printed while being transferred at a speed the same as that of the print drum.

The sheet detecting sensor 33*b* is provided for detecting a state of the primary sheet supply of the print sheet P by the sheet supply apparatus 10. The primarily supplied print sheet P reaches a timing roll portion constituting one portion of the secondary sheet supply means.

The sheet detecting sensor 33*b* is constituted by a light projecting and receiving sensor and detects that the print sheet P reaches the timing roll portion by shielding (OFF) light (time tA in FIG. 4(*c*)).

Further, the control means 35 is constituted such that the control means 35 stops (OFF) the sheet supply clutch 34 when a predetermined time period (T2) has elapsed (time tB) since OFF of the sheet detecting sensor 33*b* even in a time period of an ON state of the sheet supply clutch 34 by OFF of the rotation detecting sensor 33*a*.

As described above, a timing of making ON the sheet supply clutch 34 is produced by a sheet supply state (sheet supply signal ON) and when the rotation detecting sensor 33*a* is made ON and the primary sheet supply is started by making ON the sheet supply clutch 34.

In the meantime, a timing of making OFF the sheet supply clutch 34 is produced when there is detected at an earliest timing of any one of a state in which a sheet is not supplied (sheet supply signal OFF), or after elapse of the time period T2 since OFF of the sheet detecting sensor 33*b*, or OFF of the rotation detecting sensor 33*a* (time tC).

Thereby, the sheet supply means 10 supplies the print sheet P intermittently by providing the time period TA of executing sheet supply in which the scraper roller is rotated by rotating means and the time period TB of not executing sheet supply in which the scraper roller 11 is brought into a free state, in one sheet supply operation (one period T).

Next, an explanation will be given of control content of left and right movement of the sheet supply table 3 according to the above-described constitution in reference to a flowchart of FIG. 5 and timing charts of FIGS. 6(*a*), 6(*b*) and 6(*c*).

Further, in the following time period of control, the image forming apparatus 2 is assumed to continue printing operation. During the printing operation, the sheet supply clutch 34 is made ON intermittently at the period T in correspondence with the printing speed (FIG. 6(*b*)) and the print sheet P is primarily supplied by the sheet supply means 10. Further, during the printing operation, the topmost face of the print sheet P is disposed at the sheet supply position which is brought into contact with the sheet supply means 10. The sheet supply position indicates a state in which the scraper roller 11 of the sheet supply means 10 is brought into contact with the print sheet P loaded above the sheet supply table 3, the upper limit sensor 14 is brought into an ON state and sheet can be supplied.

Figure 6:
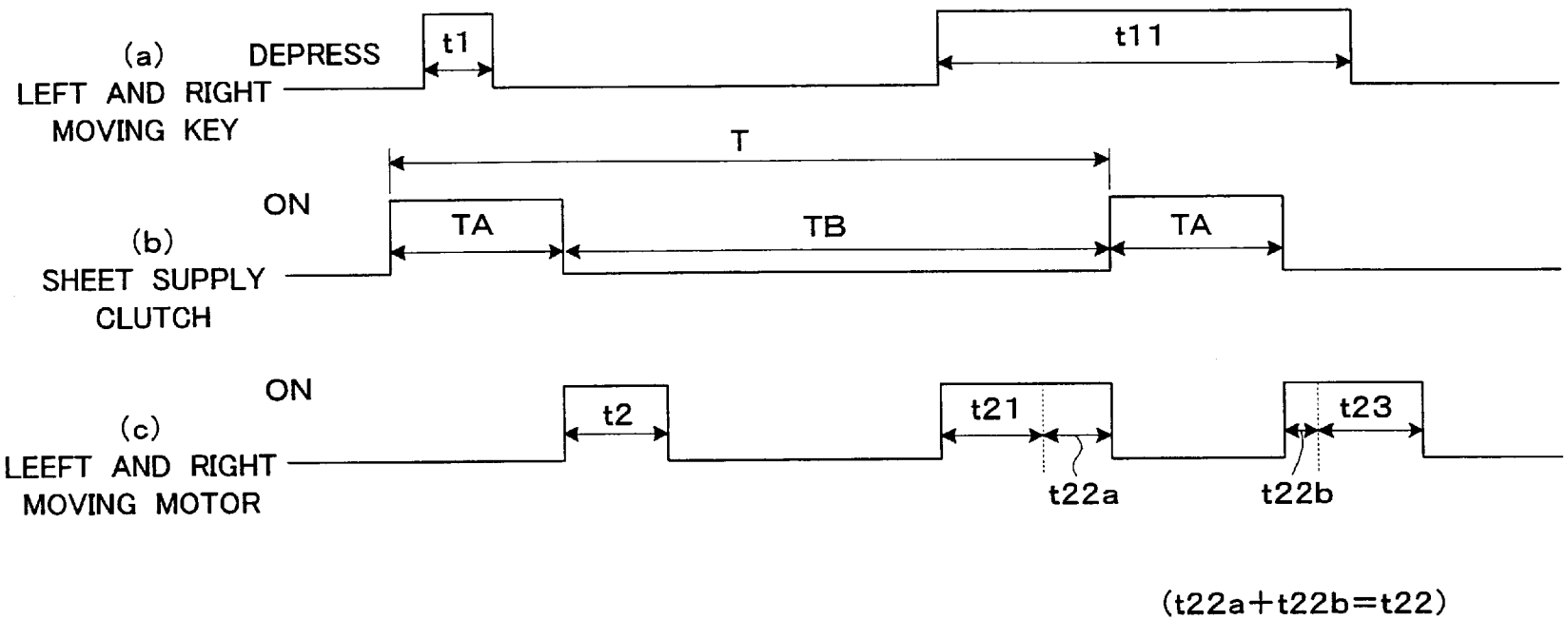
FIGS. 6(*a*), 6(*b*) and 6(*c*) are timing charts showing the control content of the movement of the sheet supply table in the left and right direction.

In the printing operation, when the left and right moving key 30*b* is operated to depress once (time period t1 of FIGS. 6(*a*)), the control means 35 starts left and right movement control.

First, the operation detects a state of the sheet supply clutch 34 (SP1). When the sheet supply clutch 34 is brought into the ON state (time period TA of FIG. 6(*b*)), the print sheet P is brought into a transfer state by the sheet supply means 10. Therefore, left and right movement of the sheet supply table 3 is carried out during a time period of OFF of the sheet supply clutch (within a range of time period TB of FIG. 6(*b*)). That is, when the sheet feed clutch 34 is made ON (SP1-YES), the operation awaits for OFF of the sheet supply clutch 34 (SP1-NO).

Next, the operation determines whether the left and right moving key 30*b* is operated in the right direction or in the left direction (SP2). In the case of operating the left and right moving key 30*b* in the right direction (SP2-YES), the operation moves the sheet supply table 3 in the right direction by regularly rotating the left and right moving motor 18 (SP4) during a time period until the sheet supply table 3 is detected by the right limit switch 23*a* (SP3-NO).

The control means 35 monitors the state of the sheet supply clutch 34 during the time period of moving the sheet supply table 3 (SP5).

During the time period in which the sheet supply table 3 can be moved in the right direction, the operation regularly rotates the left and right moving motor 18 continuously until a constant time period t2 (FIG. 6(*c*)) has elapsed by pressing down the left and right moving key 30*b* once (loop of SP6-NO). The constant time period t2 is set to a time period of moving the sheet supply table 3 by, for example, 0.5 mm.

In the time period of moving the sheet supply table 3 in the right direction in this way, when the sheet supply clutch 34 is made ON (SP5-YES), the operation stops to rotate the left and right moving motor 18 regularly and temporarily stops movement of the sheet supply table 3 in the right direction (SP7).

Further, the operation continues the temporarily stopped state until the sheet supply clutch 34 is made OFF (loop of SP8-YES) and by making OFF the sheet supply clutch 34 (SP8-NO), the operation can return to SP3 and can restart to move the sheet supply table 3 in the right direction at SP4.

As described above, by depressing the left and right moving key 30*b* once in the right direction, the control means 35 moves the sheet supply table 3 in the right direction by the constant distance (0.5 mm) in correspondence with the constant time period t2. Further, when the sheet supply table 3 is moved in the right direction by the constant distance, the operation stops the left and right moving motor 18 and holds the sheet supply table 3 at the position (SP9).

Thereafter, at SP10, the control processing of left and right movement is finished either in the case in which a state in which depression of the left and right moving key 30*b* is released (SP10-NO) and in the case in which the sheet supply table 3 is detected to reach the right limit position by the right limit switch 23*a*.

In the meantime, at SP10, when the left and right moving key 30*b* is continuously depressed (SP10-YES), the operation returns to SP3 and repeats the processing of moving the sheet supply table 3 in the right direction. When left and right movement length of the sheet supply table 3 is long, the left and right moving key 30*b* tends to be operated to depress continuously for a comparatively long time period.

Figure 5:
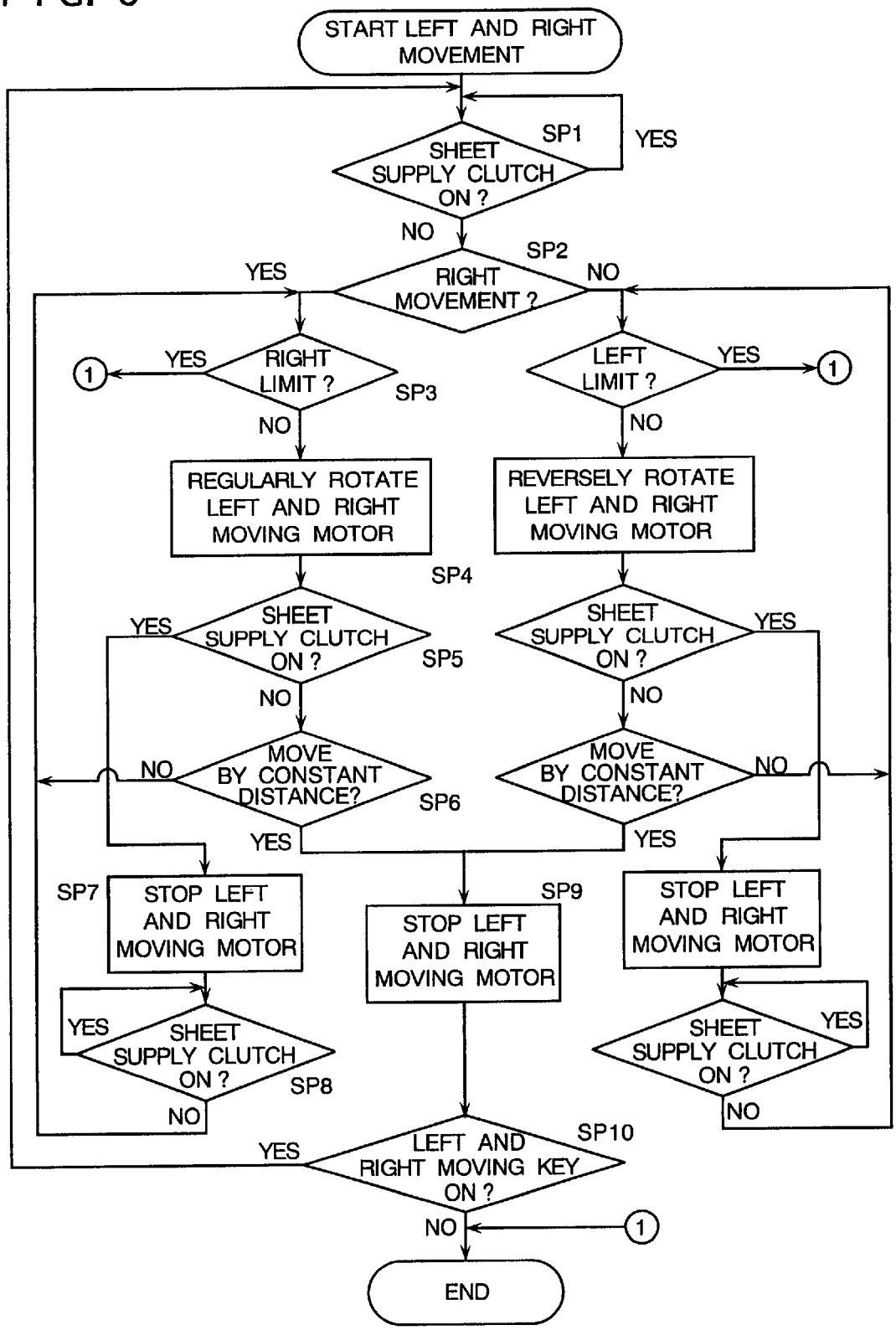
FIG. 5 is a flowchart showing control content of movement of a sheet supply table in the left and right direction.

Even when the operation is carried out, the control means 35 invariably executes the control processings of SP1 through SP10 along the flowchart described in FIG. 5.

In this case, when the time period t1 of depressing the left and right moving key 30*b* is long (illustrated as t11), a loop processing from SP10 to SP3, mentioned above, is executed. Thereby, a plurality of times (t21, t22, t23,) of processings of moving the sheet supply table 3 in the right direction during the time period of the constant time period t2 are continuously repeated.

However, when the sheet supply clutch 34 is made ON during elapse of the constant time period t2 of moving the sheet supply table 3, as shown by FIG. 6(*c*), movement of the sheet supply table 3 in the right direction is immediately stopped. In that case, the sheet supply table 3 is moved in the right direction during a constant time period t22a. The sheet supply table 3 is restarted to move in the right direction by a remaining time period (t22b of the constant time period t22) immediately after making OFF the sheet supply clutch 34. Thereafter, after releasing to depress the left and right moving key 30*b*, the right movement of the sheet supply table 3 is stopped.

Further, in the left and right movement control, mentioned above, operation in the left direction (SP2-NO) is similar thereto except that the respective processings of SP3 through SP8 are respectively changed to processings in the left direction and an explanation thereof will be omitted. In these processings, the detection processing by the right limit switch 23*a* (SP3) is changed to detection processing of the left limit switch 23*b*.

By the above-described control, when the left and right moving key 30*b* is operated to depress, the sheet supply table 3 is moved in the left and right direction only during the time period in which the sheet supply clutch 34 is made OFF (print sheet P is not primarily supplied).

By making OFF the sheet supply clutch 34, the driving rotation of the scraper roller 11 of the sheet supply means 10 is stopped. Thereafter, during the time period in which the sheet supply clutch 34 is made OFF, the scraper roller 11 is driven to rotate by transfer force of the print sheet P supplied by operating the secondary sheet supply means.

During the time period in which the scraper roller 11 is driven to rotate in this way, even when the sheet supply table 3 is moved in the left and right direction as described above, unnecessary force is not exerted among the scraper roller 11, the pickup roller 12 and the print sheet P and skewed supply, sheet folding or wrinkle is not caused in the print sheet P during the sheet supply operation and sheet supply jam is not caused.

Figure 7:
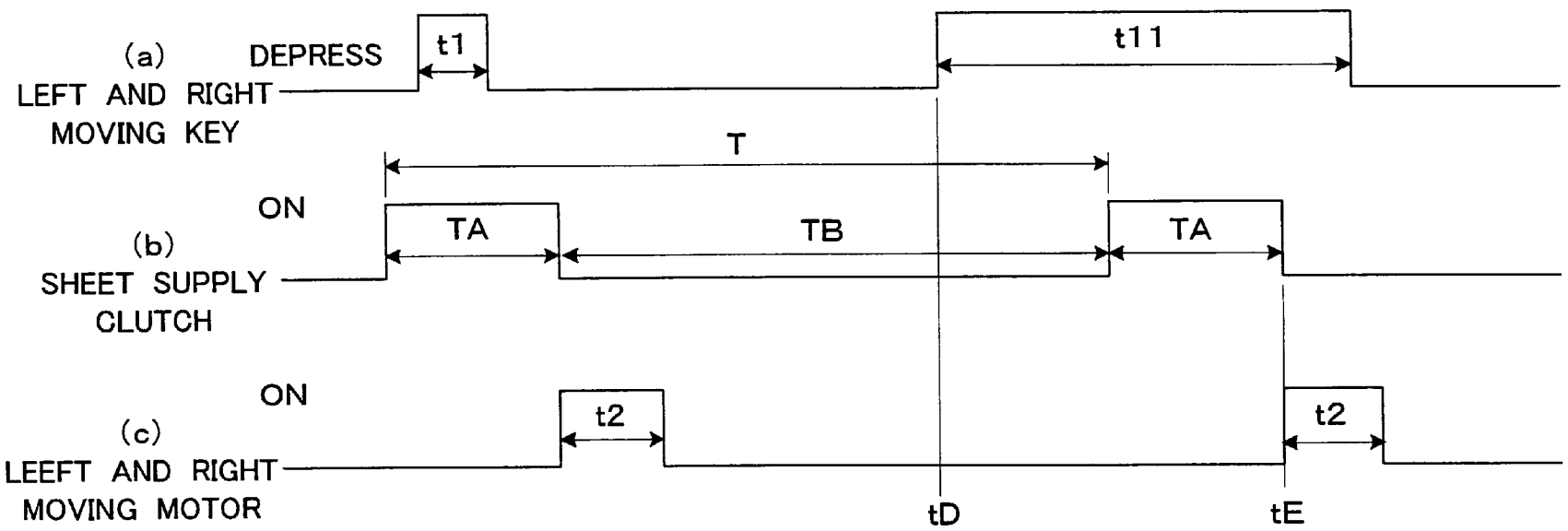
FIGS. 7(*a*), 7(*b*) and 7(*c*) are timing charts showing other example of control of moving the sheet supply table in the left and right direction.
Figure 8:
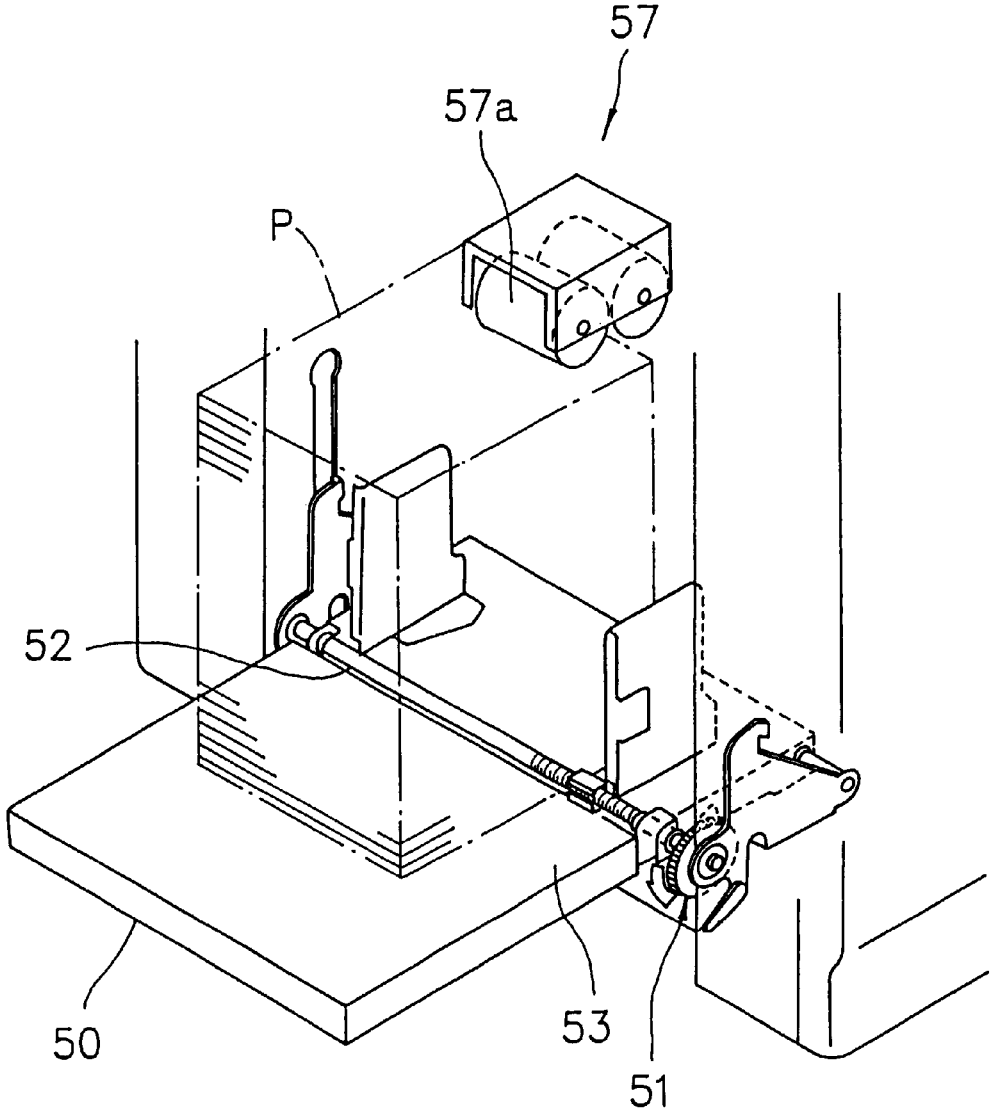
FIG. 8 is a perspective view showing a sheet supply apparatus.

Next, FIGS. 7(*a*), 7(*b*) and 7(*c*) are timing charts showing other embodiment of left and right movement control, described above. According to the embodiment, there is constructed a constitution in which the sheet supply table 3 is moved (finely moved) in the left and right direction only once during a time period (t2) in the time period of supplying the print sheet P once (one period T).

That is, by depressing the left and right moving key 30*b* once, the sheet supply table 3 is controlled to move in the left and right direction by driving the left and right moving motor 18 during the predetermined time period t2 once within the time period (TB) of making OFF the sheet supply clutch 34.

For example, even when the left and right moving key 30*b* is continuously depressed (predetermined time period till) as shown by FIG. 7(*a*), the sheet supply table 3 is prohibited to immediately move in the left and right direction depending on time of depressing the left and right moving key 30*b* (time tD). That is, at the time tD, the left and right movement control has been carried out once already in the above-described one period T.

In this case, when the time period of depressing the left and right moving key 30*b* continues into the period T at a successive time, by continuously depressing the left and right moving key 30*b*, when the sheet supply clutch 34 is made OFF successively (time TE), the left and right movement of the sheet supply table 3 can be executed only once by the predetermined time period (t2).

According to the above-described control, when the left and right moving key 30*b* is depressed during the sheet supply operation, left and right movement distance of the sheet supply table 3 is restricted to constitute always a constant distance in the time period of one period (TB) in which the sheet supply clutch 34 is made OFF. Specifically, even when the left and right moving key 30*b* is continuously depressed, the sheet supply table 3 is prohibited to move considerably in cooperation with the operation.

Thereby, the left and right position of printing can be moved without causing damage to the print sheet P at the topmost face which is brought into contact with the scraper roller 11 of the sheet supply means 10 even in the sheet supply operation.

According to the first aspect of the present invention, there is constructed the constitution in which when the image position on the record sheet is adjusted in the left and right direction, the sheet supply table is controlled to move during the time period in which the sheet supply operation by the sheet supply means is not executed and accordingly, unnecessary force is not exerted on the record sheet, skewed supply, folding or wrinkle of the record sheet is not caused in the sheet supply operation and sheet supply jam can be prevented.

Although the sheet supply operation of the sheet supply means is not executed when the sheet supply table is controlled to move in the left and right direction, according to the second aspect of the present invention, the record sheet can be transferred by the transfer means of the image forming apparatus, during the time period, there is brought about a state in which the sheet supply roller is driven to rotate by transfer force of the record sheet and accordingly, the sheet supply table can be adjusted in the left and right direction. Thereby, the position of forming the image on the record sheet can be adjusted in the left and right direction without stopping image forming operation and while continuously executing the image forming operation and the operational efficiency of the apparatus can be promoted.

According to the third aspect of the present invention, the control means is constituted to move the sheet supply table in the left and right direction by the constant amount in the corresponding direction at each instruction of the left and right movement instructing means, a moving amount of the left and right movement can be prescribed by one instruction and the left and right movement can be adjusted finely and in a short period of time.

According to the fourth aspect of the present invention, the control means is constituted to move the sheet supply table in the left and right direction by the constant amount only once in the corresponding direction during the time period of not executing the sheet supply operation within the one period of the sheet supply means regardless of the state of continuing the one time instruction of the left and right movement instructing means by the one time instruction and accordingly, the moving amount of the left and right movement with regard to one sheet of the record sheet can be fixed and force exerted on the record sheet can be minimized.

Further, when there is constructed the constitution according to the fifth aspect of the present invention in which in the case in which sheet supply is executed in the midst of adjusting the sheet supply table in the left and right direction, the operation awaits unit executing the sheet supply at a successive time, the sheet supply table can be moved in the left and right direction always by a constant amount when the one time instruction is given and the image forming position can be adjusted in the left and right direction by a desired movement amount.

According to the sixth aspect of the present invention, instruction of the left and right movement can be carried out only by operating to depress the left and right moving key and the image forming position can be adjusted in the left and right direction simply and swiftly.

What is claimed is:

1. A sheet supply apparatus for supplying record sheets to an image forming apparatus, said sheet supply apparatus comprising:

a sheet supply table for supporting the record sheets stacked thereon;

sheet supply means provided above the sheet supply table and contacting a topmost one of the record sheets for supplying the one record sheet to the image forming apparatus during each period comprising a sheet supply executing time period for supplying the record sheet to the image forming apparatus and a sheet supply non-executing time period for not supplying the record sheet thereto;

left and right movement instructing means for instructing to move the sheet supply table in a direction orthogonal to a transfer direction of the record sheet;

left and right moving means for moving the sheet supply table in response to an instruction from the left and right movement instructing means; and control means for executing a control of moving the sheet supply table when a sheet supply operation by the sheet supply means is stopped in the sheet supply nonexecuting time in the case in which the control means is instructed to move the sheet supply table by the left and right movement instructing means.

2. The sheet supply apparatus according to claim 1, further comprising:

transfer means which is provided on a side of the image forming apparatus and to which the sheet supply means delivers the record sheet;

wherein the sheet supply means includes a sheet supply roller and a sheet supply clutch for transmitting a drive force to the sheet supply roller; and wherein the control means moves the sheet supply table in a left and right direction during a time period in which the sheet supply roller is driven to rotate by the record sheet transferred by the transfer means by cutting the sheet supply clutch.

3. The sheet supply apparatus according to claim 1, wherein the control means executes a control of moving the sheet supply table by a constant amount in a corresponding direction each time of operating the left and right movement instructing means by one time.

4. The sheet supply apparatus according to claim 1, wherein the control means executes a control of moving the sheet supply table in a left and right direction by a constant amount in a corresponding direction only once in the sheet feed nonexecuting time period within the one period of the sheet supply means regardless of a duration time period of operating the left and right movement instructing means by one time and by an operation of the one time.

5. The sheet supply apparatus according to claim 1, wherein when the sheet supply means executes to supply the record sheet during a time period of operating the left and right movement instructing means by one time, the control means controls to move the sheet supply table by a remaining moving amount of a constant amount of moving the sheet supply table in a left and right direction at a time point at which the period of the sheet supply means is switched to the sheet supply nonexecuting time period.

6. The sheet supply apparatus according to claim 1, wherein the left and right movement instructing means includes a left and right moving key for moving the sheet supply table in either desired direction of left and right directions; and wherein the control means is constituted to control to move the sheet supply table in the left and right direction by detecting a state of depressing the left and right moving key.

* * * * *